US009428319B2

(12) United States Patent
Dimitrov

(10) Patent No.: US 9,428,319 B2
(45) Date of Patent: Aug. 30, 2016

(54) INFLATABLE SNOWSHOE AND RUCKSACK FOR ITS STORAGE

(75) Inventor: Petar Dimitrov, Sofia (BG)

(73) Assignee: SMALL FOOT LTD., Sofia (BG)

( * ) Notice: Subject to any disclaimer, the term of this patent is extended or adjusted under 35 U.S.C. 154(b) by 447 days.

(21) Appl. No.: 13/983,371

(22) PCT Filed: Feb. 2, 2012

(86) PCT No.: PCT/BG2012/000003

§ 371 (c)(1),
(2), (4) Date: Aug. 2, 2013

(87) PCT Pub. No.: WO2012/103605

PCT Pub. Date: Aug. 9, 2012

(65) Prior Publication Data

US 2013/0305569 A1 Nov. 21, 2013

(30) Foreign Application Priority Data

Feb. 4, 2011 (BG) ..... 11 0843

(51) Int. Cl.

| | |
|---|---|
| ***A43B 5/18*** | (2006.01) |
| ***B65D 85/18*** | (2006.01) |
| ***A43B 13/20*** | (2006.01) |
| ***A45F 3/04*** | (2006.01) |
| *A63C 13/00* | (2006.01) |

(52) U.S. Cl.

CPC ..... *B65D 85/187* (2013.01); *A43B 13/203* (2013.01); *A43B 13/206* (2013.01); *A45F 3/04* (2013.01); *A63C 13/005* (2013.01); *A63C 13/001* (2013.01); *A63C 13/003* (2013.01); *A63C 13/006* (2013.01); *A63C 2203/16* (2013.01)

(58) Field of Classification Search

CPC A63C 2203/16; A43B 13/20; A43B 13/203; A43B 13/206

USPC ..... 36/116, 122–125

See application file for complete search history.

(56) References Cited

U.S. PATENT DOCUMENTS

| | | | | |
|---|---|---|---|---|
| 3,423,852 | A * | 1/1969 | Smith | A43B 13/20 36/7.5 |
| 4,525,941 | A * | 7/1985 | Ruth, Jr. | A43B 5/18 36/116 |
| 4,676,009 | A * | 6/1987 | Davis | A43B 5/18 36/116 |
| 4,720,927 | A * | 1/1988 | Abegg | A63C 13/001 36/122 |
| 6,367,674 | B1 | 4/2002 | Tabor | |
| 6,763,617 | B1 | 7/2004 | Stafford | |
| 2003/0172554 | A1 * | 9/2003 | Chavet | A43B 3/0026 36/113 |

FOREIGN PATENT DOCUMENTS

JP 10 024140 A 1/1998

* cited by examiner

*Primary Examiner* — Ted Kavanaugh
(74) *Attorney, Agent, or Firm* — Ladas & Parry LLP

(57) ABSTRACT

The invention relates to a snowshoe and rucksack for its storage with an application in the sports sphere and in particular on snow covered and ice-frozen terrains. The inflatable snowshoe contains a corpus and fixing belts. The corpus consists of a cylindrical air chamber and protective case. The air chamber forms a closed contour having the form of an elliptical ring with a circular cross section and is placed in the protective case. The air chamber has a valve mounted on it the end of which passes through an opening formed in the rear part of the protective case. The protective case is made of separate sections of a strong, wear-resistant material. The frontal part of protective case contains three sections which are raised in relation to the horizontal axis under an angle of α, which falls within the interval between 35° to 40°. Over the entire internal circumference of protective case there is a zipper, ensuring quick and easy placing of the air chamber in casing. Fixing belts are provisioned respectively for the front and rear part of the shoe. To the lower part of the fixing belts for the frontal part of the surface metal spikes are mounted in a mobile way and they ensure a better grip of ice-frozen terrains. The rucksack has been especially designed for the storage of the snowshoe in its inflated state and under given conditions it also plays the role of a back protector. The profile of the rucksack corresponds completely to the profile of the snowshoe.

9 Claims, 4 Drawing Sheets

INFLATABLE SNOWSHOE AND RUCKSACK FOR ITS STORAGE

RELATED APPLICATION INFORMATION

This application is a 371 of International Application PCT/BG2012/000003 filed 2 Feb. 2012 entitled "Inflatable Snowshoe And Rucksack For Its Storage", which was published in the English language on 9 Aug. 2012, with International Publication Number WO 2012/103605 A1, and which claims priority from Bulgaria Patent Application 110843 filed 4 Feb. 2011, the content of which is incorporated herein by reference.

FIELD OF THE INVENTION

The invention relates to a snowshoe and rucksack for its storage with an application in the sports sphere and in particular on snow covered and ice-frozen terrains.

BACKGROUND OF THE INVENTION

U.S. Pat. No. 6,763,617 discloses an inflatable snowshoe, which includes a corpus and a number of crosswise and longitudinal strips, covering the corpus, thus forming a horizontal base. The corpus is a cylindrical, air-filled chamber the free ends of which are joined with a clamp in a way to form a closed contour in the form of a drop. The corpus has an air valve. Fixing belts are provisioned for the frontal part of the shoe.

The known snowshoe is intended only for leveled terrains and small slopes. On greater slopes, its air chamber tends to bend under the pressure thus becoming unstable. The availability of numerous crosswise and longitudinal strips, forming the bottom of the snowshoe also effect its stability. The rear part of shoe is free, due to which the person using the snowshoe can not enjoy considerable stability.

TECHNICAL DESCRIPTION OF THE INVENTION

The main goal of the invention is to create an inflatable snowshoe with a stable and reliable construction for use on various terrains as well as to be easily transportable and be easy to assemble and disassemble.

Another objective of the invention is the designing of a rucksack for storing the snowshoe in its inflatable state, which should also serve as an efficient back protector.

This task is solved by an inflatable snowshoe that includes a corpus and fixing belts for the shoe. According to the invention, the corpus consists of a cylindrical air chamber and a protective case. The air chamber forms a closed contour with the shape of an elliptic ring with a circular cross section and it is placed in the protective case. An air valve is mounted on the air chamber and the end of this valve passes through an opening, formed on the rear of the protective case. This case consists of separate sections made of strong, wear-resistant material where the separate sections are of varying lengths, joined permanently one to another. Three of the sections, forming the frontal part of the protective case, are raised above the horizontal axis at an angle of $\alpha$, which falls within from 35° to 40° range. There is a zipper, located along the entire internal circumference, which ensures access to the air chamber. In the frontal part, sideways to the interior surface of the protective case and under the level of the zipper, the fixing belts of the frontal part of the shoe are mounted. In the rear part, sideways to the exterior surface of the protective case and under the level of the zipper, the fixing belts of the shoe's heels are mounted. The fixing belts for the frontal and rear part of the shoe have lockable buckles with the respective adjusting devices. The locking buckles are protected from freezing by a protective case. The lower part of the fixing belts, which contacts the terrain, is located under the exterior level of the protective case at a distance of "h". Movable metal spikes are mounted to the lower part of the fixing belts for the frontal part of the shoe. Reinforcement strips are mounted on the exterior side of the side sections of the protective case as well as on the lower surface of the fixing belts contacting the terrain.

The specially designed rucksack for storing the snowshoe in its inflated state consists of a case and adjustable tightening strips, mounted immobile in the upper and lower rear part of the casing. The free ends of the strips end with lockable buckles. The case is formed of separate sections with immobile joints between each other. Three of the sections in the upper part of the case are placed at an angle $\beta$ relative to the side sections so that the profile of the case corresponds to the case of the snowshoe. At least ⅓ of the perimeter of the sidewise located exterior surrounding surface of the case there is a zipper. The case of the rucksack has a main and an additional section divided by a separator. The main section is larger than the additional and permits the placing of one inflated snowshoe. On the exterior surface of the side walls rings are mounted. The case of the rucksack and the protective casing of the snowshoe are made of one and the same wear-resistant material.

The protective casing, made of wear-resistant material, protects the air chamber from damages and punctures by hard, sharp objects. The reinforcing strips add an additional security to the snowshoe against damages. The zipper on the protective case permits the quick and easy placement and extracting of the air chamber from the case.

Thanks to the raised frontal part of the protective case, and from here the frontal part of the snowshoe itself, the easy and unimpeded climbing of sloping terrains is easy as the frontal part does not permit the front of the shoe to get dug in the snow.

The easy and quick mounting of the spikes adds to the unobstructed movements on icy ground.

The availability of fixing belts for the frontal and rear part of the shoe fasten the shoe to the snowshoe and ensure stable walking. The belt adjusters permit the use of the snowshoe with various shoe sizes.

The location of the lower part of the fixing belts under the level of the protective case guarantees a firmer grip of the terrain.

The locking buckles have a protective case which protects them from the accumulation of snow and a possible subsequent freezing.

The rucksack with the inflated snowshoe in it protects the user (the person wearing the gear) from unwanted traumas when falling. Thus there is no necessity of a back protector and this decreases considerably the overall weight of the gear during longer marches.

DESCRIPTION OF THE ENCLOSED FIGURES

The invention is further explained with the example of preferred embodiment illustrated in the attached figures, wherein.

Figure 1:
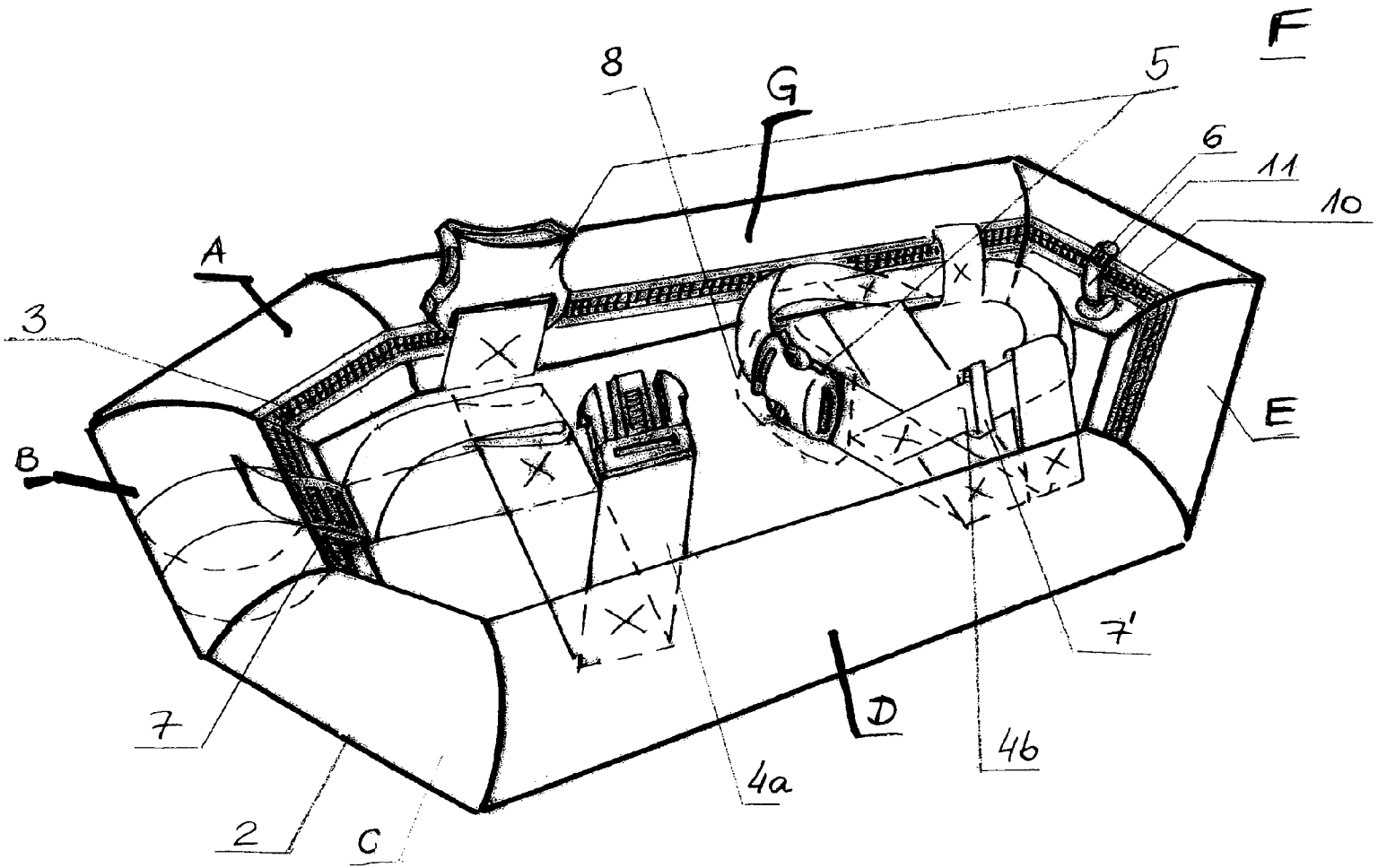
FIG. 1 shows a general axonometric view of the snowshoe without the spikes.
Figure 3:
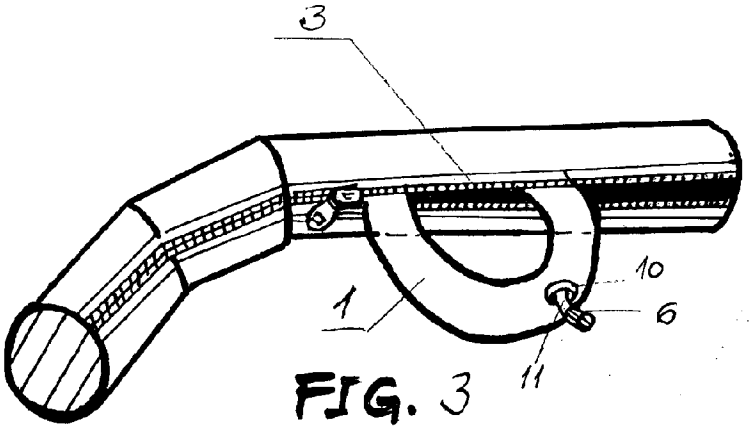
FIG. 3 shows a part of the protective casing when the air chamber is placed in it.
Figure 4:
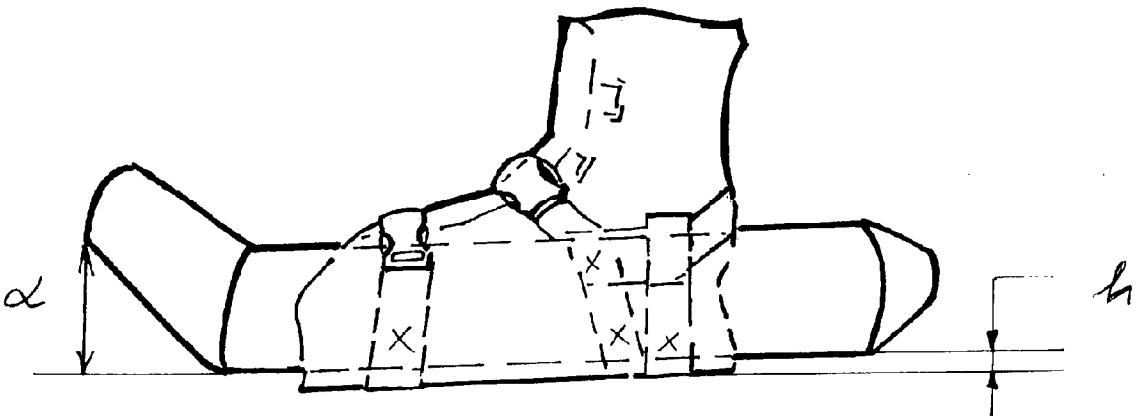
FIG. 4 shows a side view of the snowshoe with a shoe placed in it.
Figure 2:
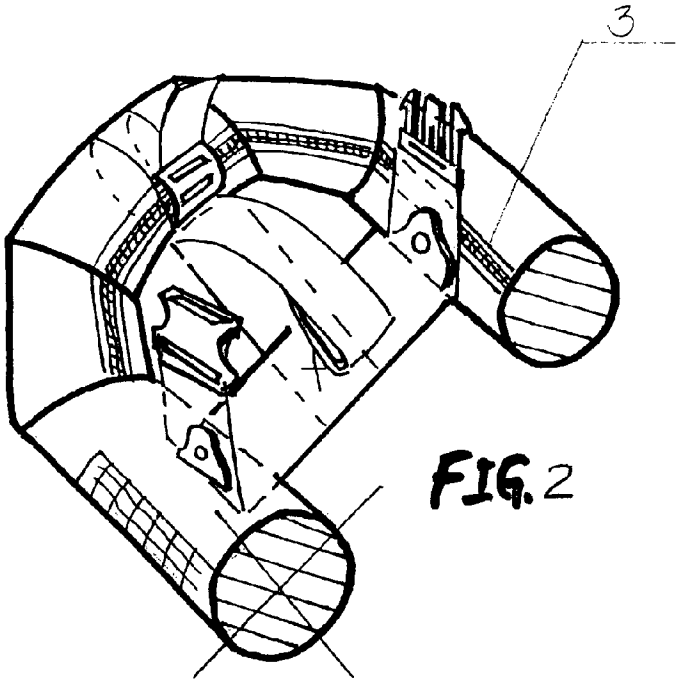
FIG. 2 shows an axonometric view of the frontal part of the snowshoe.
Figure 5A:
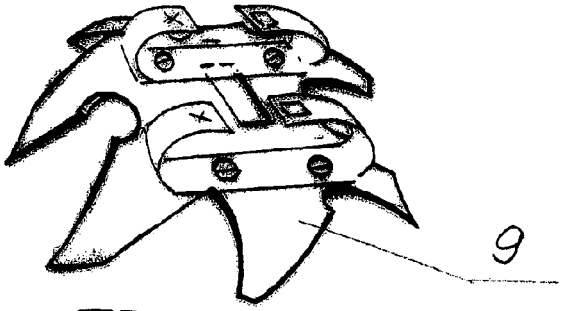
FIG. 5 is a view of the snowshoe from below, with mounted spikes.
Figure 5:
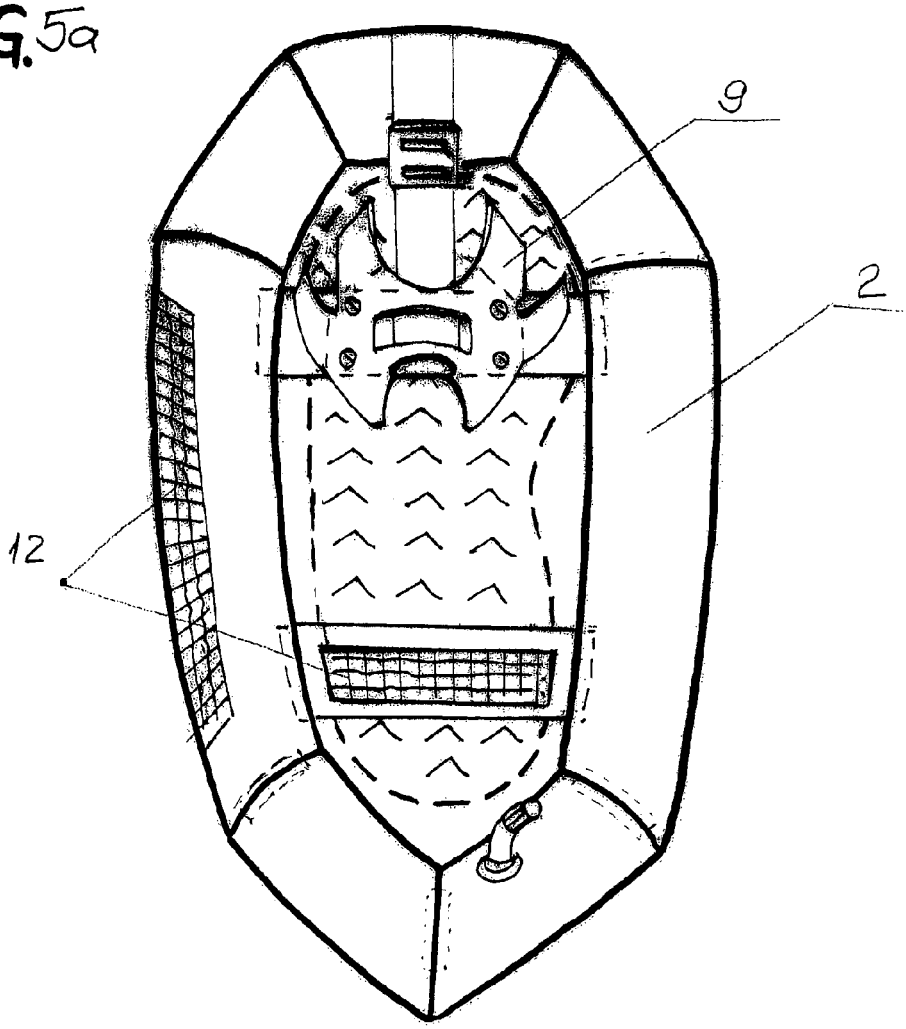
Figure 6:
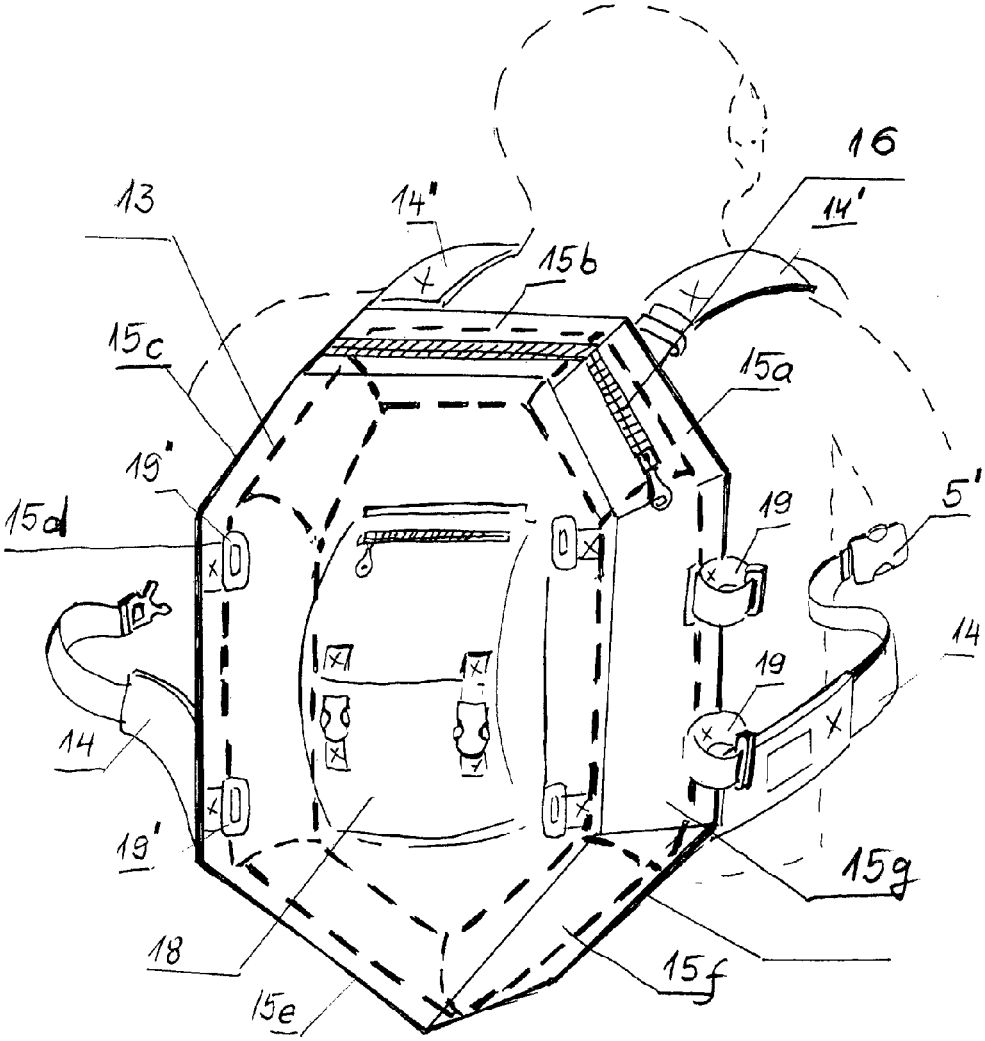
Figure 6A:
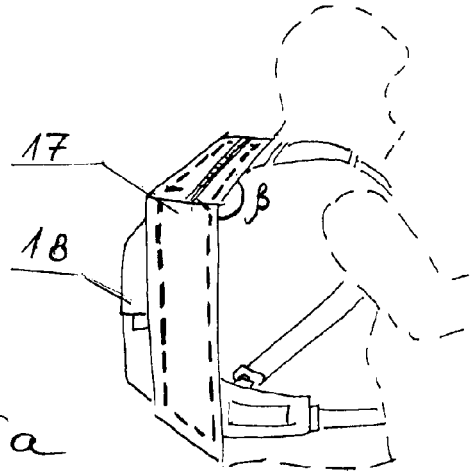

FIG. 5*a* shows a general view of the spikes;

FIG. 6 shows a general view of the rucksack containing the inflated snowshoe;

FIG. 6*a* shows a side view of the rucksack.

EXAMPLES OF PREFERRED EMBODIMENTS

The inflatable snowshoe, illustrated in the attached figures, contains a corpus and fixing belts. The corpus consists of a cylindrical air chamber 1 and protective case 2. The air chamber 1 forms a closed contour having the form of an elliptical ring with a circular cross section and is placed in the protective case 2. The air chamber 1 has a valve 6 mounted on it the end 11 of which passes through an opening 10 formed in the rear part of the protective case 2. Via the valve 6, the inflation of the air chamber 1 is performed. The protective case 2 is made of separate sections of a strong, wear-resistant material. The separate sections are of varying length and are sewn one to another in a way which gives a cylindrical profile to the protective case 2. The side sections of the protective case 2 are of greater length that the frontal and rear sections. The frontal part of protective case 2 contains three sections which are raised in relation to the horizontal axis under an angle of $\alpha$, which falls within the interval between 35° to 40°. Over the entire internal circumference of protective case 2 there is a zipper 3, ensuring quick and easy placing of the air chamber 1 in casing 2. In the frontal part and sideways to the interior surface of the protective case 2, under the level of the zipper 3 fixing belts 4*a* are permanently mounted for the front part of the shoe. In the rear and sideways to the exterior surface of protective case 2, under the level of the zipper 3 fixing belts 4*b* are permanently mounted for the heel of the shoe. The fixing belts 4*a* and 4*b* respectively for the front and rear part of the shoe are protected against freezing via the protective case 8. The adjusting devices 7, 7' to the buckles can be widened and narrowed depending on the size of the shoe. The lower part of the fixing belts 4*a* and 4*b*, which contacts with the terrain, is located under the level of the exterior surface of protective case 2 at a distance of "h". To the lower part of the fixing belts 4*a* for the frontal part of the surface, metal spikes 9 are mounted in a mobile fashion and they ensure a better grip of ice-frozen terrains. On the exterior side of the side sections of protective case 2, as well as on the lower surface of fixing belts 4*a* and 4*b*, which contacts with the terrain, reinforcement strips 12 are placed.

The rucksack shown on FIGS. 6 and 6*a* is especially designed for the storage of the snowshoe in its inflated state and under given conditions it also plays the role of a back protector.

The profile of the rucksack corresponds completely to the profile of the snowshoe. The rucksack includes a corpus 13 and adjustable tightening strips 14, 14' which are immobile and mounted on the upper and lower parts of the corpus 13. The free ends of the strips 14, 14' are fitted with lockable buckles 5'. The corpus 13 is formed of separate sections 15*a*, 15*b*, 15*c*, 15*d*, 15*e*, 15*f*, 15*g*, which are permanently joined one to another. Three of the sections—15*a*, 15*b*, 15*c* in the upper part of the corpus 13 are placed at an angle of $\beta$ relative to side sections 15*d* and 15*g* so that the profile of corpus 13 corresponds to the profile of case 2 of the snowshoe. On at least ⅓ of the perimeter of the exterior side surface of the corpus 13 a zipper 16 is mounted. The corpus 13 of the rucksack has a main section 17 and an additional section 18, divided by a separator wall. The main section 17 is larger that the additional one 18 and permits the placement of the snowshoe in its inflated state. This way, reinforced by the inflated snowshoe, the corpus 13 serves as a back protector. Along the exterior surface of the side walls of corpus 13 rings 19, 19' are mounted. The corpus 13 and the protective case 2 of the snowshoe are made of one and the same wear-resistant material.

Using the Invention

In a disassembled state, the snowshoe is placed in a small sack with a size of 20-15-5. After taking it out of the sack the zipper 3 of the protective case 2 is opened and in the interior of the case 2 the air chamber 1 is placed in away that the end 11 of the valve 6 passes through the opening 10, made in the casing 2. The zipper 3 is then closed. With a pump, compressed air is entered in the air chamber 1 until the air chamber 1 completely fills the interior volume of case 2. After this the snowshoe is put on and via the fixing belts 4*a* and 4*b* and buckles 5 the shoe is fixed in its frontal and rear part.

When necessary and during the crossing of steep and hard terrains the spikes 9 can be mounted to the lower part of the belts 4*a*.

After use, the valve 6 is opened and the air is let out of the air chamber 1. The disassembled snowshoe is returned back in the sack.

In certain cases the person, using the snowshoe, does not disassemble it but after taking it off the foot it is placed in the main section 17 of corpus 13 of the rucksack. In the additional section 18 the air pump is kept. The rings 19, 19' are used to hold ski sticks or some other equipment in order to free the hands of the user to give him/her better support when crossing difficult terrains. After this, the rucksack is placed on the back of the user and via the tightening strips 14 it is fixed to his/her body. In this way, the corpus 13 is reinforced with the inflated snowshoe and serves as a back protector against possible traumas and injuries.

The invention claimed is:

1. An inflatable snowshoe, including a corpus and fixing belts for a frontal part of a shoe, where the corpus is a cylindrical air chamber forming a closed contour, and an air valve is mounted on an air chamber, wherein the closed contour, formed by the air chamber (1) has the form of an elliptical ring with circular cross section where the air chamber (1) is placed in a protective case (2) with a cylindrical profile, made of a strong wear-resistant material, where the protective case (2) is formed in separate sections (A,B,C,D,E,F,G) having different lengths, immovably connected one to another where three of the sections (A,B,C) forming a frontal part of the protective case (2) are raised relative to a horizontal axis under an angle of $\alpha$, while the entire interior circumference of the protective case (2) has a zipper (3) for access to the air chamber (1) and fixing belts (4*a*) for the frontal part of the shoe are immovably mounted sideways and in the frontal part of the exterior surface of the protective case (2) under a level of the zipper (3), where to a lower part of the fixing belts (4*a*) for a frontal part of a shoe metal spikes (9) are movably attached, whereupon at a rear part and sideways to an exterior surface of the protective case (2) under the level of the zipper (3) fixing belts (4*b*) are permanently fixed for a heel of the shoe, and in the rear part of the protective case (2) an opening has been made (10) which holds the end nozzle (11) of the air valve (6).

2. The inflatable snowshoe according to claim 1, wherein the fixing belts for the frontal part (4*a*) and for the heel (4*b*) of the shoe have locking buckles (5) and can be adjusted by adjusters (7, V).

3. The inflatable snowshoe according to claim 2, wherein the locking buckles (5) are protected by a case (8) against freezing.

4. The inflatable snowshoe according to claim 1, wherein the angle α between the frontal part of the protective case (2) and the horizontal axis is within the interval between 35° and 40°.

5. The inflatable snowshoe according to claim 1, wherein the lower part of the fixing belts (4*a*, 4*b*) contacting a terrain is located below the level of the exterior surface of the protective case (2) at a distance of "h".

6. The inflatable snowshoe according to claim 1, wherein on an exterior side of side sections of the protective case (2) as well as on a lower surface of the fixing belts (4*a*, 4*b*) contacting with a terrain reinforcement strips (12) are mounted.

7. A rucksack for storing the snowshoe according to claim 1, wherein the rucksack includes the corpus (13) and adjustable tightening strips (14, 14') which are immobile and mounted on an upper and lower parts of the corpus (13), wherein free ends of strips (14, 14') are fitted with lockable buckles (5'), and the corpus (13) is formed of separate sections (15*a*, 15*b*, 15*c*, 15*d*, 15*e*, 15*f*, 15*g*), which are permanently joined one to another, where three of the sections—(15*a*, 15*b*, 15*c*) in the upper part of the corpus (13) are placed at an angle of β relative to side sections (15*d* and 15*g*) so that the profile of corpus (13) corresponds to the profile of case (2) of the snowshoe, also wherein at least ⅓ of a perimeter of an exterior side surface of the corpus (13) a second zipper (16) is mounted and where the corpus (13) of the rucksack has a main section (17) and an additional section (18), divided by a separator wall, while along the exterior surface of the side walls of corpus (13) rings (19, 19') are mounted.

8. A rucksack according to claim 7, wherein the corpus (13) and the case (2) of the snowshoe are made of one and the same wear-resistant material.

9. A rucksack for storing the snowshoe according to claim 1, wherein the main section (17) is larger than the additional section (18).

* * * * *